US009511376B2

(12) United States Patent
Makowski

(10) Patent No.: US 9,511,376 B2
(45) Date of Patent: Dec. 6, 2016

(54) SLUICE PLATE WITH SPIRAL POCKETS

(71) Applicant: Bernard Makowski, Wickenburg, AZ (US)

(72) Inventor: Bernard Makowski, Wickenburg, AZ (US)

( * ) Notice: Subject to any disclaimer, the term of this patent is extended or adjusted under 35 U.S.C. 154(b) by 0 days.

(21) Appl. No.: 14/852,328

(22) Filed: Sep. 11, 2015

(65) Prior Publication Data

US 2016/0074871 A1 Mar. 17, 2016

Related U.S. Application Data

(60) Provisional application No. 62/049,269, filed on Sep. 11, 2014.

(51) Int. Cl.
*B03B 5/28* (2006.01)
*B03B 5/32* (2006.01)
*B03B 5/26* (2006.01)

(52) U.S. Cl.
CPC .. *B03B 5/32* (2013.01); *B03B 5/26* (2013.01)

(58) Field of Classification Search
CPC ..... B03B 5/26; B03B 5/32
USPC ..... 209/44, 506, 724
See application file for complete search history.

(56) References Cited

U.S. PATENT DOCUMENTS 2,100,262 A * 11/1937 Moorhead ..... C22B 11/12 209/43
4,592,833 A * 6/1986 Perdue ..... B03B 7/00 209/44
5,927,509 A * 7/1999 Lord ..... B03B 5/02 209/44
7,892,847 B2 * 2/2011 Ito ..... B01D 15/1807 165/152
8,678,192 B1 * 3/2014 Pung ..... B03B 5/26 209/18

* cited by examiner

*Primary Examiner* — Terrell Matthews

(57) ABSTRACT

A sluice plate for capturing and concentrating heavy metal particles has a main plate and a plurality of spiral pockets. The main plate includes a main body and a drafting surface over which a processing mixture flows. The plurality of spiral pockets traverses into the main body through the drafting surface, wherein the plurality of spiral pockets collects heavy metal particles from the processing mixture. Each of the plurality of spiral pockets has a lateral wall that tapers from an upper opening to a lower face. An inner lip is perimetrically and helically positioned along the lateral wall. The inner lip and the tapered nature of each of the plurality of spiral pockets facilitates the movement of the processing mixture within the plurality of spiral pockets, along with the stratification of the heavy metal particles.

19 Claims, 6 Drawing Sheets

SLUICE PLATE WITH SPIRAL POCKETS

The current application claims a priority to the U.S. Provisional Patent application Ser. No. 62/049,269 filed on Sep. 11, 2014.

FIELD OF THE INVENTION

The present invention relates generally to sluices. More specifically, the present invention is a sluice plate with spiral pockets which is intended for implementation as a component in a sluice box used to capture and concentrate heavy metal particles from a flow of processing material such as water containing crushed ores.

BACKGROUND OF THE INVENTION

Gold has been a practical and symbolic store of value for human beings since prehistoric times. Modern chemistry arose from alchemy, a discipline which attempted to find a way to make gold from common substances. Many cultures throughout history have used gold as backing for their currency because of its enduring value. Even in the days of fiat currencies, the ubiquity of gold in electronics, dentistry, jewelry, the arts, medicine, and even food and beverages keep the demand for gold strong. Important cities and cultural centers have begun because of prospectors flocking to the area to seek the precious metal. Modern day mining operations use large and complex automated systems to extract gold from the earth but there are many locations with gold deposits in which large-scale industrial mining operations are commercially unviable. Ultra-fine gold, in particular, is a relatively untapped resource which is best captured by individuals and small teams with the right tools.

Therefore it is the object of the present invention to disclose a mechanism and method for use in a sluice box whereby ultra-fine gold and other dense metals can be more effectively captured than is possible with current methods. The present invention is a sluice plate with spiral pockets that is used to extract heavy metal particles from a processing mixture. Furthermore, the present invention allows for the stratification of the heavy metal particles due to the creation of pressure differentials about a plurality of spiral pockets. Each of the plurality of spiral pockets is tapered downwards and has a spiraling inner lip, which facilitates the separation of the heavy metal particles by density.

DETAIL DESCRIPTIONS OF THE INVENTION

All illustrations of the drawings are for the purpose of describing selected versions of the present invention and are not intended to limit the scope of the present invention.

The present invention is a sluice plate with spiral pockets that is intended for implementation as a component in a sluice box used to capture and concentrate heavy metal particles, particularly gold or platinum particles between 3 and 10 microns in size, from a flow of processing material such as water containing crushed ores. The spiral pockets and other components of the sluice plate induce regions of high and low pressure within the processing material, thereby stratifying the contents of the processing material permitting the separation and sequestration of higher density metals such as gold and platinum. The present invention can also be used in conjunction with other components such as drop pans, support buckets, and high banker attachments, stream flares, waterfall heads, or dredge crash boxes, and any other components of a placer mining system which may facilitate the properly conditioned supply of processing material at the proper flow rate for the proper functioning of the sluice plate with spiral pockets, and to avoid cavitation at any point in the flow.

Figure 1:
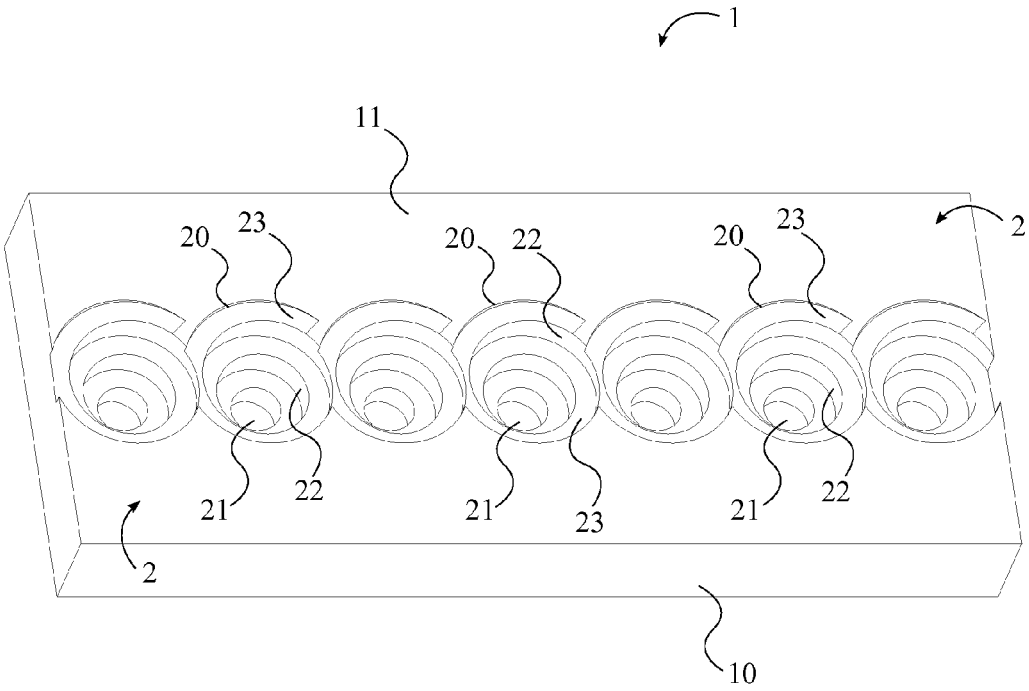
FIG. 1 is a perspective view of the present invention, showing the helically positioned inner lip within each of the plurality of spiral pockets; the plurality of spiral pockets being linearly positioned across the main body.

In reference to FIG. 1, the present invention comprises a main plate 1 and a plurality of spiral pockets 2. The main plate 1 provides a solid structure over which a mixture such as water and heavy metal particles is passed, while the plurality of spiral pockets 2 is used to the collect heavy metal particles from the mixture. The main plate 1 comprises a main body 10 and a drafting surface 11, wherein the drafting surface 11 overlays the main body 10, providing the top surface of the main plate 1 over which the mixture is passed. The main body 10 is a flat, elongated structure into which the plurality of spiral pockets 2 is positioned, while the drafting surface 11 is a flat surface that is intended to induce a consistent laminar flow of the mixture (i.e. processing material).

Figure 2:
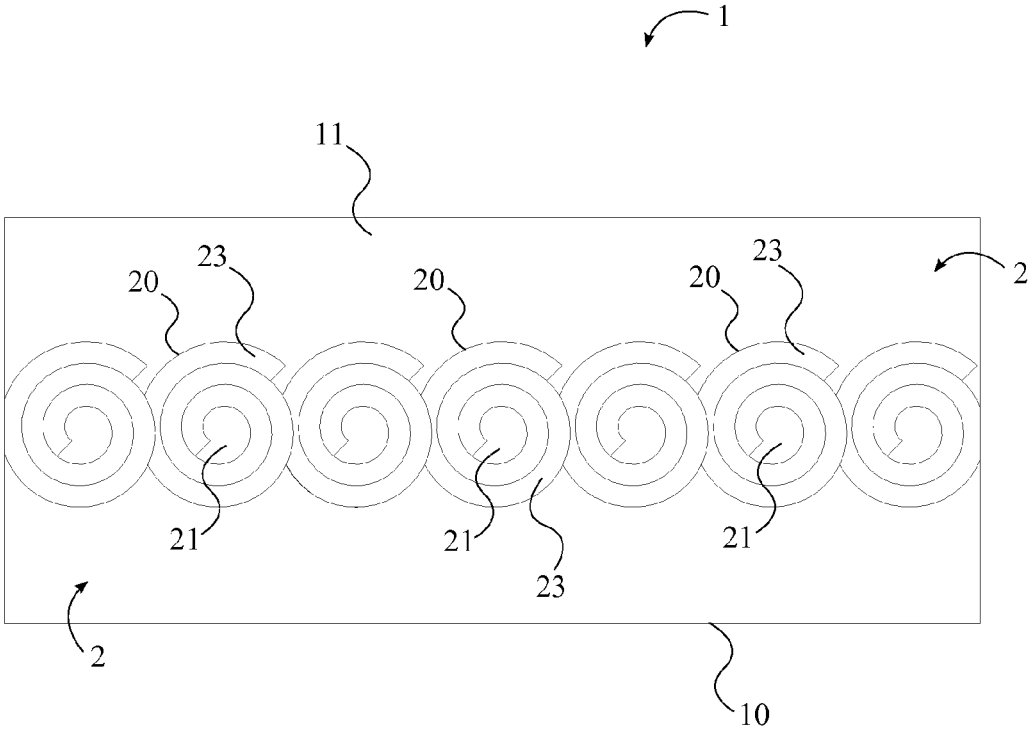
FIG. 2 is a top plan view of the present invention, wherein the upper opening is coplanar with the drafting surface, and the upper opening and the lower face are concentric.

In reference to FIG. 1-2, the plurality of spiral pockets 2 is positioned across the main body 10, wherein each of the plurality of spiral pockets 2 traverses into the main body 10 through the drafting surface 11. More specifically, the plurality of spiral pockets 2 is positioned between a first lateral edge and a second lateral edge of the main body 10; the first lateral edge and the second lateral edge being terminally positioned opposite each other along the main body 10, forming the sides of the main plate 1. In the preferred embodiment of the present invention, the plurality of spiral pockets 2 is linearly positioned across the main body 10.

In reference to FIG. 2, the plurality of spiral pockets 2 is arranged across the main body 10 such that each of the plurality of spiral pockets 2 overlaps an adjacent pocket. For example, for the plurality of spiral pockets 2 having an arbitrary pocket, a previous pocket, and a subsequent pocket linearly arranged, wherein the arbitrary pocket is positioned in between the previous pocket and the subsequent pocket; the previous pocket overlaps the arbitrary pocket, while the arbitrary pocket overlaps the subsequent. The overlapping of the plurality of spiral pockets 2 ensures that heavy metal particles can be extracted from the mixture across the entire length of the main plate 1.

In reference to FIG. 1, each of the plurality of spiral pockets 2 comprises an upper opening 20, a lower face 21, a lateral wall 22, and an inner lip 23. The upper opening 20 for each of the plurality of spiral pockets 2 forms the top of the pocket, wherein the upper opening 20 is coplanar with the drafting surface 11. In this way, as the mixture flows across the drafting surface 11 and subsequently the plurality of spiral pockets 2, heavy metal particles may sink and enter the plurality of spiral pockets 2 where the heavy metal particles become trapped. The upper opening 20 may have any ellipsoid or polygonal geometry including, but not limited to, circular, oval, triangular, or trapezoidal geometry.

In further reference to FIG. 1, the lower face 21 of each of the plurality of spiral pockets 2 forms the bottom, closed end of the pocket. In the preferred embodiment of the present invention, the lower face 21 is parallel to the upper opening 20, however, in other embodiments of the present invention the lower face 21 may be positioned at an offset angle from the upper opening 20. Similar to the upper opening 20, the lower face 21 may have any ellipsoid or polygonal geometry, including but not limited to, circular, oval, triangular, or trapezoidal geometry. While the geometry of the lower face 21 is the same as the geometry of the upper opening 20 in the preferred embodiment of the present invention, the lower face 21 and the upper opening 20 may have different geometries in other embodiments. In general, the surface area of the upper opening 20 will be greater than the surface area of the lower face 21, especially when the lower face 21 is flat.

In one embodiment of the present invention, the upper opening 20 and the lower face 21 are both circular; the lower face 21 being smaller than the upper opening 20. Furthermore, the upper opening 20 and the lower face 21 are concentric, wherein the center of the upper opening 20 and the center of the lower face 21 are coaxial. In another embodiment of the present invention, the upper opening 20 and the lower face 21 are both trapezoidal; the lower face 21 being smaller than the upper opening 20. Again, the upper opening 20 and the lower face 21 are concentric, wherein the center of the upper opening 20 and the center of the lower face 21 are coaxial.

In reference to FIG. 1, the upper opening 20 and the lower face 21 are terminally positioned along the lateral wall 22 opposite each other. The lateral wall 22 is tapered from the upper opening 20 to the lower face 21 and provides the enclosed sides of the pocket for each of the plurality of spiral pockets 2. The inner lip 23 is perimetrically positioned about the lateral wall 22 and helically positioned along the lateral wall 22 from the upper opening 20 to the lower face 21, wherein the inner lip 23 forms a downward spiraling ramp along the lateral wall 22. Due to the tapered nature of the lateral wall 22, the inner lip 23 forms smaller and smaller loops around the lateral wall 22 as the inner lip 23 approaches the lower face 21.

In the preferred embodiment of the present invention, the inner lip 23 is continuous along the length of the lateral wall 22 forming a single downward spiraling ramp. However, in other embodiments of the present invention, the inner lip 23 may be separated, wherein gaps are present between one or more sections of the inner lip 23. In such embodiments, the inner lip 23 remains helically positioned along the lateral wall 22, wherein each of the segments adjacent to either side of a gap follow a continuous path.

The flow of the mixture over the plurality of spiral pockets 2 results in a pressure gradient with low pressure at the upper opening 20 and higher pressure at the lower face 21, as well as other fluid phenomena affecting the boundary layer characteristics of the flow. The flow of the mixture in, around, and over each of the plurality of spiral pockets 2 establishes regions of the mixture within, around, and above each of the plurality of spiral pockets 2 having different flow conditions. These resulting pressure gradients, along with the downward, tapered spiral of the inner lip 23, induce a rotating flow of the mixture within each of the plurality of spiral pockets 2 which may appear hydrocyclonic but does not comprise the discrete fluid entry and exit points which define a hydrocyclone.

At the upper opening 20 of each of the plurality of spiral pockets 2, flow is mostly laminar. This fluid can flow over the plurality of spiral pockets 2 without scrubbing out denser materials lower in the plurality of spiral pockets 2. The bottom two thirds of each of the plurality of spiral pockets 2 forms a capture zone. In the capture zones, particles of greater density separate from the flow and are kept in constant motion. This prevents saturation or "loading up" of the vortex pockets. Additionally, heavy metal particles from the mixture are stratified based on relative density with the denser materials at the bottom and the less dense materials at the top. For example, the smaller yet denser gold particles would be layered underneath the less dense yet larger magnetite particles in each of the plurality of spiral pockets 2. In a standard 'slot type' pocket no such stratification is observed.

In addition to the plurality of spiral pockets 2, the present invention may further include channels and other formations in the main body 10 to influence the flow characteristics of the mixture. In reference to FIG. 3, the present invention may further comprise a flow redirect groove 3 or a downstream gap 4. When utilized, both the flow redirect groove 3 and the downstream gap 4 are positioned adjacent to the plurality of spiral pockets 2. The flow redirect groove 3 and the downstream gap 4 can be used standalone or in tandem depending on the application of the present invention. When used in tandem, the plurality of spiral pockets 2 is positioned in between the flow redirect groove 3 and the downstream gap 4, wherein the flow redirect groove 3 is positioned upstream of the plurality of spiral pockets 2 and the downstream gap 4 is positioned downstream of the plurality of spiral pockets 2.

Figure 4:
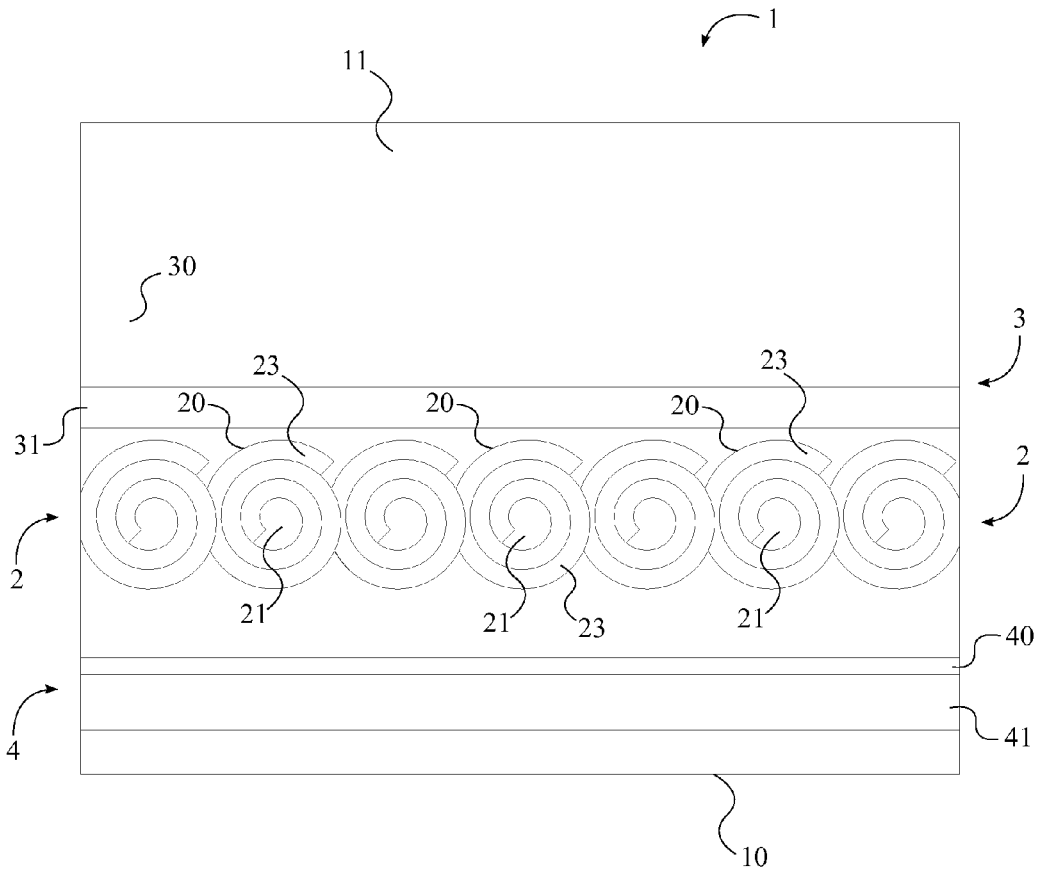
FIG. 4 is a top plan view of the present invention, wherein the flow redirect groove and the downstream gap are utilized in conjunction with the plurality of spiral pockets.
Figure 5:
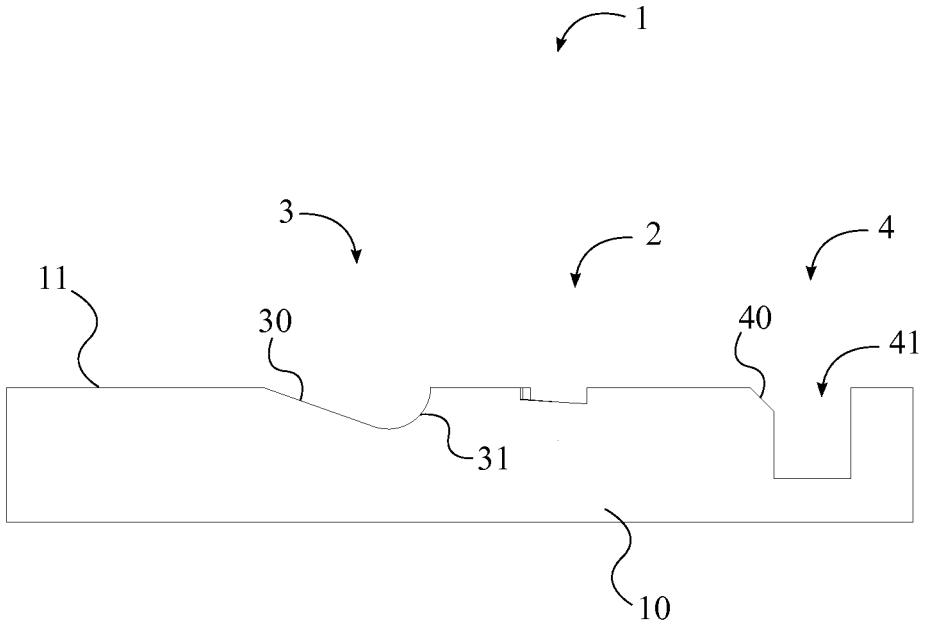
FIG. 5 is a left side elevational view of the present invention, wherein the flow redirect groove and the downstream gap are utilized in conjunction with the plurality of spiral pockets.
Figure 6:
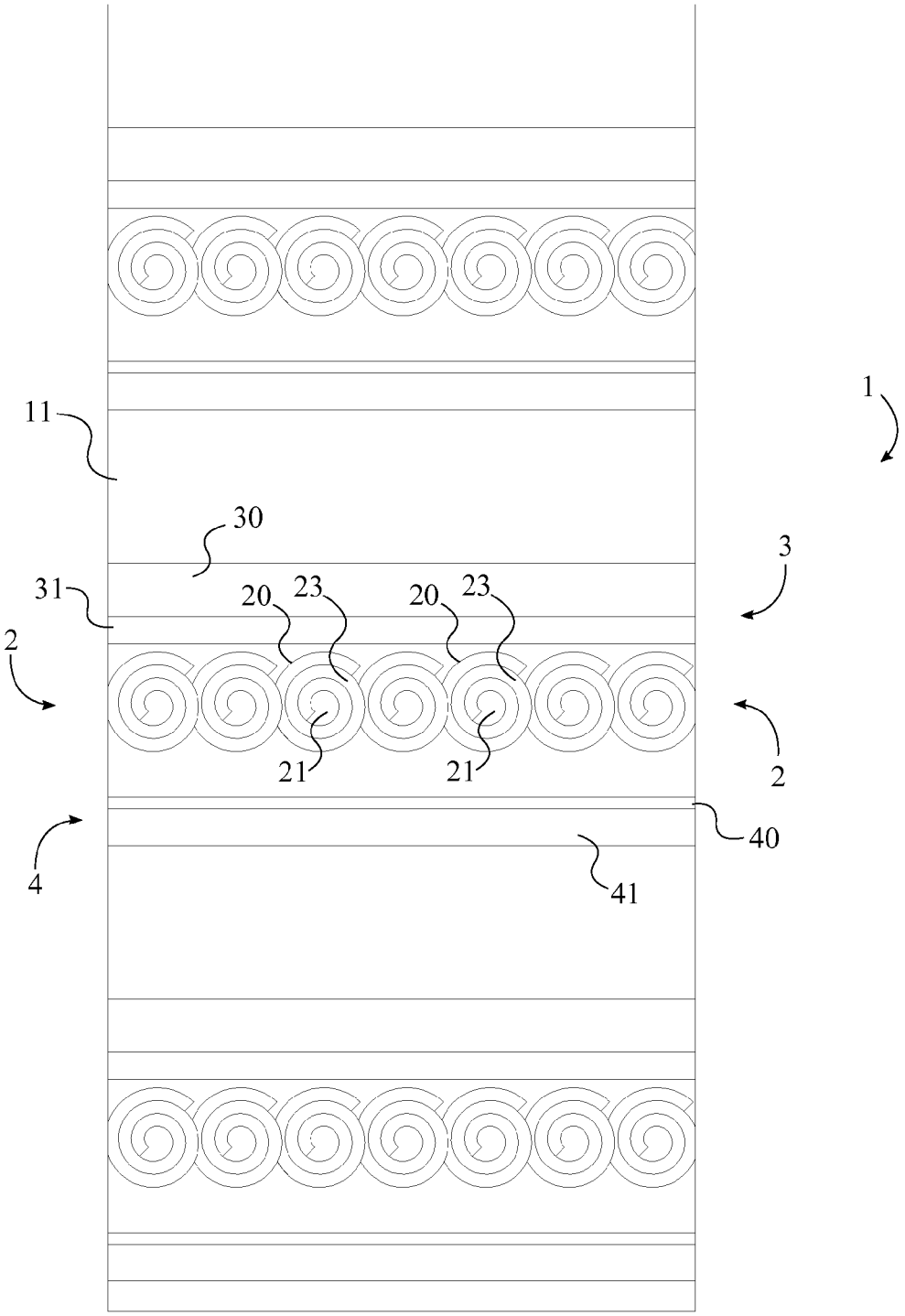
FIG. 6 is a top plan view, wherein the present invention is positioned in between adjacent sluice plates.

In reference to FIG. 4-5, similar to the plurality of spiral pockets 2, the flow redirect groove 3 is positioned across the main body 10 from the first lateral edge to the second lateral edge. The flow redirect groove 3 traverses into the main body 10 through the drafting surface 11 creating an open channel across the main plate 1. The flow redirect groove 3 can be designed to serve many purposes including, but not limited to, preventing the scrubbing out of the plurality of spiral pockets 2 in higher water flow circumstances, encouraging mixing of the constituent elements of the mixture (i.e. processing material), breaking down particles, and separating light and heavy materials. In essence, the flow redirect groove 3 is used to manipulate the consistent laminar flow induced by the drafting surface 11.

Figure 3:
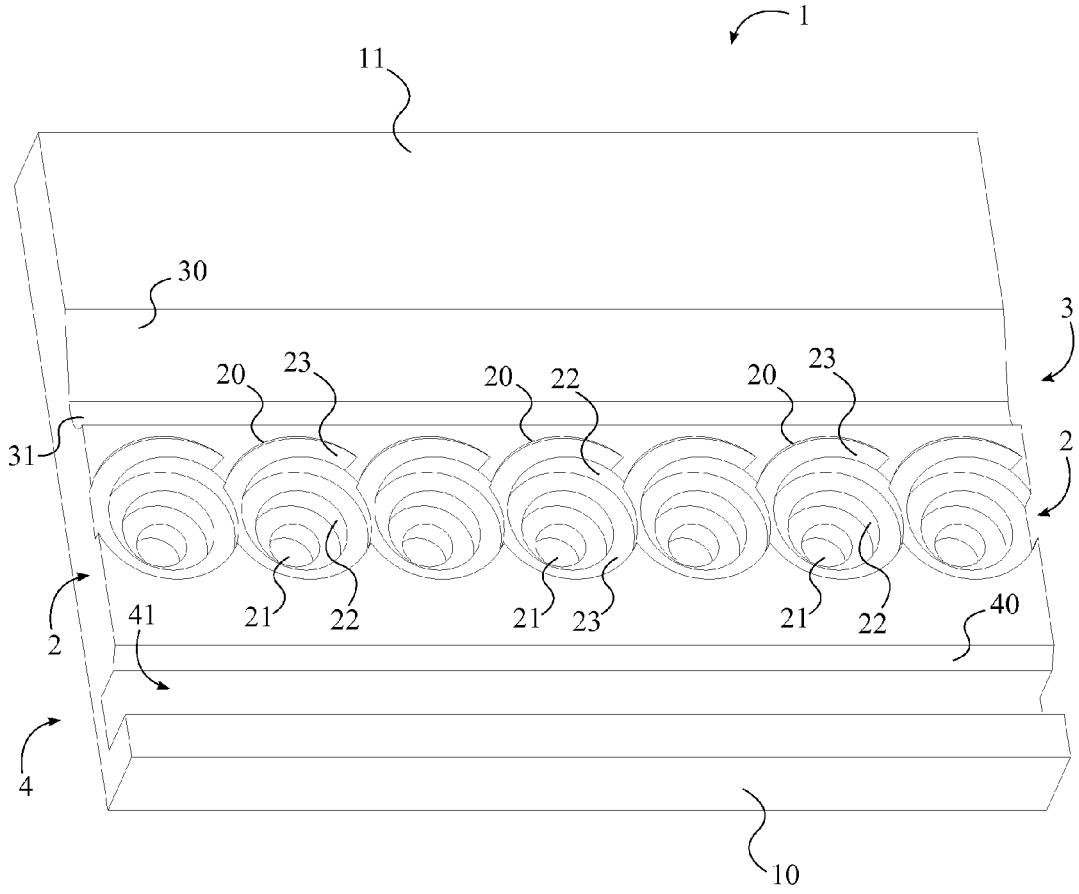
FIG. 3 is a perspective view of the present invention, wherein the flow redirect groove and the downstream gap are utilized in conjunction with the plurality of spiral pockets.

In one embodiment of the present invention, the flow redirect groove 3 comprises a flat down ramp 30 and a curved up ramp 31, as depicted in FIG. 3-5. The curved up ramp 31 is positioned adjacent to the plurality of spiral pockets 2, while the flat down ramp 30 is positioned adjacent to the curved up ramp 31 opposite the plurality of spiral pockets 2. The processing material first reaches the flat down ramp 30, which is a flat surface angled downward from the drafting surface 11. The angled down ramp imparts additional kinetic energy to the flow. Then the processing material reaches the curved up ramp 31, which is a ramp that deflects the mixture upwards, normal to the drafting surface 11. The processing material then flows from the curved up ramp 31, over the plurality of spiral pockets 2.

In reference to FIG. 4-5, similar to the flow redirect groove 3, the downstream gap 4 is positioned across the main body 10 from the first lateral edge to the second lateral edge. The downstream gap 4 traverses into the main body 10 through the drafting surface 11 creating an open channel across the main plate 1. The downstream gap 4 is a trough between an adjacent, downstream sluice plate. The downstream gap 4 may serve many purposes including buffering the flow to inhibit users from scrubbing out the plurality of spiral pockets 2 by over pouring processing material into the sluice box, capturing refuse materials such as magnetite from the flow, breaking down particles, and separating light and heavy material. After exiting the downstream gap 4, the processing material may then flow over the adjacent sluice plate.

In one embodiment of the present invention, the downstream gap 4 comprises a chamfer 40 and a horizontal channel 41, as depicted in FIG. 3-5. The chamfer 40 is positioned adjacent to the plurality of spiral pockets 2, while the horizontal channel 41 is positioned adjacent to the chamfer 40 opposite the plurality of spiral pockets 2. The chamfer 40 is a flat surface which is angled downward from the drafting surface 11. The chamfer 40 guides the processing material that has flowed over the plurality of spiral pockets 2 into the horizontal channel 41 heavy metal particles are further collected. The processing material then continues to flow out of the horizontal channel 41 and over the adjacent sluice plate.

Although the invention has been explained in relation to its preferred embodiment, it is to be understood that many other possible modifications and variations can be made without departing from the spirit and scope of the invention as hereinafter claimed.

What is claimed is:

1. A sluice plate comprises:
a main plate;
a plurality of spiral pockets;
the main plate comprises a main body and a drafting surface;
each of the plurality of spiral pockets comprises an upper opening, a lower face, a lateral wall, and an inner lip;
the plurality of spiral pockets traversing into the main body through the drafting surface;
the plurality of spiral pockets being positioned across the main body;
the upper opening being coplanar with the drafting surface;
the upper opening and the lower face being terminally positioned along the lateral wall opposite each other;
the lateral wall being tapered from the upper opening to the lower face; and
the inner lip being perimetrically positioned about the lateral wall.

2. The sluice plate as claimed in claim 1 comprises:
a flow redirect groove;
the flow redirect groove traversing into the main body through the drafting surface;
the flow redirect groove being positioned across the main body; and
the flow redirect groove being positioned adjacent to the plurality of spiral pockets.

3. The sluice plate as claimed in claim 2 comprises:
the flow redirect groove comprises a flat down ramp and a curved up ramp;
the curved up ramp being positioned adjacent to the plurality of spiral pockets; and
the flat down ramp being positioned adjacent to the curved up ramp opposite the plurality of spiral pockets.

4. The sluice plate as claimed in claim 1 comprises:
a downstream gap;
the downstream gap traversing into the main body through the drafting surface;
the downstream gap being positioned across the main body; and
the downstream gap being positioned adjacent to the plurality of spiral pockets.

5. The sluice plate as claimed in claim 4 comprises:
the downstream gap comprises a chamfer and a horizontal channel;
the chamfer being positioned adjacent to the plurality of spiral pockets; and
the horizontal channel being positioned adjacent to the chamfer opposite the plurality of spiral pockets.

6. The sluice plate as claimed in claim 1 comprises:
a flow redirect groove;
a downstream gap; and
the plurality of spiral pockets being positioned in between the flow redirect gap and the downstream gap.

7. The sluice plate as claimed in claim 1 comprises:
the inner lip being helically positioned along the lateral wall from the upper opening to the lower face.

8. The sluice plate as claimed in claim 1, wherein the upper opening and the lower face are concentric.

9. The sluice plate as claimed in claim 1 comprises:
the plurality of spiral pockets being linearly positioned across the main body.

10. A sluice plate comprises:
a main plate;
a plurality of spiral pockets;
a flow redirect groove;
the main plate comprises a main body and a drafting surface;
each of the plurality of spiral pockets comprises an upper opening, a lower face, a lateral wall, and an inner lip;
the flow redirect groove comprises a flat down ramp and a curved up ramp;
the plurality of spiral pockets traversing into the main body through the drafting surface;
the plurality of spiral pockets being positioned across the main body;
the upper opening being coplanar with the drafting surface;
the upper opening and the lower face being terminally positioned along the lateral wall opposite each other;
the lateral wall being tapered from the upper opening to the lower face;
the inner lip being perimetrically positioned about the lateral wall;
the flow redirect groove traversing into the main body through the drafting surface;
the flow redirect groove being positioned across the main body;
the flow redirect groove being positioned adjacent to the plurality of spiral pockets;
the curved up ramp being positioned adjacent to the plurality of spiral pockets; and
the flat down ramp being positioned adjacent to the curved up ramp opposite the plurality of spiral pockets.

11. The sluice plate as claimed in claim 10 comprises:
a downstream gap comprises a chamfer and a horizontal channel;
the downstream gap traversing into the main body through the drafting surface;

the downstream gap being positioned across the main body;

the plurality of spiral pockets being positioned in between the flow redirect gap and the downstream gap;

the chamfer being positioned adjacent to the plurality of spiral pockets; and the horizontal channel being positioned adjacent to the chamfer opposite the plurality of spiral pockets.

12. The sluice plate as claimed in claim 10 comprises:

the inner lip being helically positioned along the lateral wall from the upper opening to the lower face.

13. The sluice plate as claimed in claim 10, wherein the upper opening and the lower face are concentric.

14. The sluice plate as claimed in claim 1 comprises:

the plurality of spiral pockets being linearly positioned across the main body.

15. A sluice plate comprises:

a main plate;

a plurality of spiral pockets;

a downstream gap;

the main plate comprises a main body and a drafting surface;

each of the plurality of spiral pockets comprises an upper opening, a lower face, a lateral wall, and an inner lip;

the downstream gap comprises a chamfer and a horizontal channel;

the plurality of spiral pockets traversing into the main body through the drafting surface;

the plurality of spiral pockets being positioned across the main body;

the upper opening being coplanar with the drafting surface;

the upper opening and the lower face being terminally positioned along the lateral wall opposite each other;

the lateral wall being tapered from the upper opening to the lower face;

the inner lip being perimetrically positioned about the lateral wall;

the downstream gap traversing into the main body through the drafting surface;

the downstream gap being positioned across the main body;

the downstream gap being positioned adjacent to the plurality of spiral pockets;

the chamfer being positioned adjacent to the plurality of spiral pockets; and the horizontal channel being positioned adjacent to the chamfer opposite the plurality of spiral pockets.

16. The sluice plate as claimed in claim 15 comprises:

a flow redirect groove comprises a flat down ramp and a curved up ramp;

the flow redirect groove traversing into the main body through the drafting surface;

the flow redirect groove being positioned across the main body;

the plurality of spiral pockets being positioned in between the flow redirect gap and the downstream gap;

the curved up ramp being positioned adjacent to the plurality of spiral pockets; and the flat down ramp being positioned adjacent to the curved up ramp opposite the plurality of spiral pockets.

17. The sluice plate as claimed in claim 15 comprises:

the inner lip being helically positioned along the lateral wall from the upper opening to the lower face.

18. The sluice plate as claimed in claim 15, wherein the upper opening and the lower face are concentric.

19. The sluice plate as claimed in claim 1 comprises:

the plurality of spiral pockets being linearly positioned across the main body.

* * * * *